US006516878B1

(12) United States Patent
McGarian et al.

(10) Patent No.: US 6,516,878 B1
(45) Date of Patent: Feb. 11, 2003

(54) DOWNHOLE TENSION SWIVEL SUB

(75) Inventors: Bruce McGarian, Aberdeen (GB); Lawrence R. Barr, Aberdeen (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/743,327

(22) PCT Filed: Jul. 6, 1999

(86) PCT No.: PCT/GB99/02155

§ 371 (c)(1),
(2), (4) Date: Mar. 14, 2001

(87) PCT Pub. No.: WO00/03116

PCT Pub. Date: Jan. 20, 2000

(30) Foreign Application Priority Data

Jul. 9, 1998 (GB) ..... 9814933

(51) Int. Cl.[7] ..... E21B 17/02

(52) U.S. Cl. ..... 166/242.7; 166/55.7; 166/117.7; 166/136

(58) Field of Search ..... 166/298, 55, 55.7, 166/117.7, 123, 136, 242.7

(56) References Cited

U.S. PATENT DOCUMENTS 4,191,255 A * 3/1980 Rives ..... 166/297
4,550,781 A 11/1985 Kagler, Jr.
5,018,580 A * 5/1991 Skipper ..... 166/298
5,253,710 A 10/1993 Carter et al.
5,984,006 A * 11/1999 Read et al. ..... 166/63

FOREIGN PATENT DOCUMENTS

| | | |
|---|---|---|
| EP | 0155129 | 9/1985 |
| EP | 0370744 | 5/1990 |
| WO | 9719248 | 5/1997 |
| WO | 9829637 | 7/1998 |

* cited by examiner

*Primary Examiner*—David Bagnell
*Assistant Examiner*—Zakiya Walker
(74) *Attorney, Agent, or Firm*—Dykema Gossett PLLC

(57) ABSTRACT

A downhole equipment for use in the gas and oil drilling industry includes a first elongate member arranged in telescopic relation with a second elongate member, the elongate members being moveable relative to one another between a retracted position in which at least one tooth provided on the first elongate member is engaged with at least one tooth provided on the second elongate member so as to prevent relative rotation therebetween, and an extended position in which the at least one tooth of the second elongate member so as to permit relative rotation between the elongate members and in which abutment surfaces of the elongate members are in mechanical communication with each other so as to prevent further extending telescopic movement, Thus, the apparatus may be located between a spear and rotary easing cutter for setting the spear and for holding a casing and cutting string in tension while the casing is severed.

7 Claims, 2 Drawing Sheets

DOWNHOLE TENSION SWIVEL SUB

This invention relates to downhole equipment for use in the gas and oil drilling industry.

It is a frequent requirement of the gas and oil drilling industry to cut and remove sections of a wellbore casing. Typically, a casing cutter having extendable cutting blades is run into the wellbore and located adjacent the section of casing to be severed. The cutter is rotated and the cutting blades extended so as to engage the inner casing surface. Extension of the cutting blades continues until the blades completely penetrate the casing to create two separate casing portions. The uphole casing portion may be then removed from the wellbore as necessary.

On occasions, there is also a requirement to cut a wellbore casing whilst maintaining the portion of casing located below the cut in a state of tension. However, adequate means for satisfying this requirement has not previously been available.

It is an object of the present invention to provide apparatus for allowing a casing to be severed whilst maintaining a portion of casing below the region of severing in a state of tension.

It is a further object of the invention to provide such apparatus which is also compatible with a conventional casing cutter.

The invention provides apparatus for use in a wellbore, the apparatus comprising a first elongate member provided with at least one tooth, a second elongate member provided with at least one tooth; the first and second elongate members being arranged in telescopic relation to one another so as to be moveable relative to one another in a longitudinal direction between a retracted position, in which the at least one tooth of the first elongate member is engaged with the at least one tooth of the second elongate member so as to prevent relative rotation between said elongate members, and au extended position, in which the at least one tooth of the first elongate member is completely disengaged from the at least one tooth of the second elongate member so as to permit relate rotation between said elongate members and abutment surfaces of said elongate members are in mechanical communication with each other so as to prevent further extending longitudinal movement of said elongate members and thereby permit the transmission of a tension force through the apparatus via mean provided on each of the first and second elongate members for connecting said members, when in use, to additional apparatus.

In use, a conventional casing cutter may be attached uphole of the aforementioned apparatus (a "tension swivel sub") to one of the elongate members (e.g the first elongate member) whilst a casing spear is attached downhole of the apparats to the other of the elongate members (e.g. the second elongate member). The resultant cutting sting may be then run into a wellbore and located at the required depth. The casing spear may be set by means of an appropriate string rotation which is transmitted to the spear through the engagement of the elongate member teeth. Once the spear has been set so as to grip the wellbore casing, an uphole force may be applied to the string which moves the elongate member from the retracted position to the extended position. The abutment surfaces of the elongate members are thereby placed in mechanical communication with each other, and as a result, the uphole force places the region of casing located below the spear in a state of tension. Furthermore, movement of the elongate members into the extended position disengages the teeth thereby allowing free rotation of the elongate member attached to the casing cutter and the cutting string located thereabove. Thus, the casing cutter may be then rotated so as to sever the wellbore casing. Once the cutting operation has been completed, the uphole force on the cutting string, and accordingly the tension in the casing below the spear, may be slowly reduced to zero. The teeth of the elongate members are then re-engaged so as to permit rotation of the elongate member attached to the spear and thereby release the spear from the wellbore casing.

Preferably, biasing means is provided to bias the first and second elongate members into the retracted position. The biasing means is ideally a spring which may be located between the abutment surfaces of said elongate members. It is preferable for the spring to have sufficient stiffness to maintain the elongate members in the retracted position when, during use, the apparatus is placed in a state of tension due to the suspension of downhole equipment from said apparatus. Furthermore, a bearing is preferably located between the abutment surfaces of said elongate members. The first and second elongate members are preferably each provided with a multiplicity of teeth.

Thus, the apparatus of the invention provides means for setting a spear and for holding a casing and cutting sting in tension while the casing is severed above the spear by means of a conventional rotary casing cutter. Furthermore, once the casing has been cut, the tension in the casing and cutting string may be reduced in a controlled mariner and the spear may be thereby conveniently released.

An embodiment of the present invention will now be described with reference to the accompanying drawings, in which.

Figure 1:
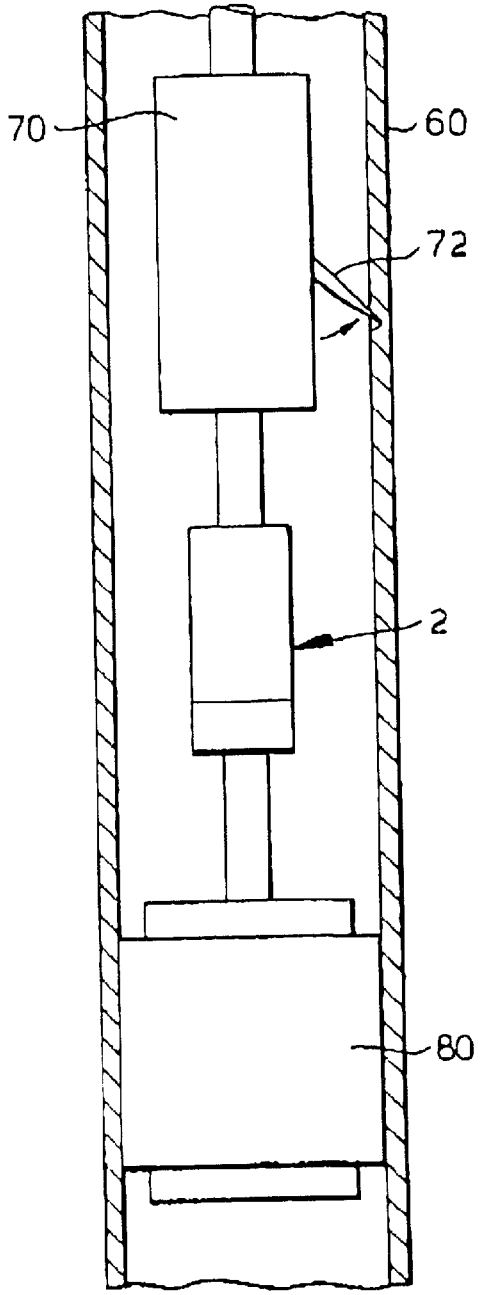
FIG. 1 is a schematic view of apparatus according to the invention located in a wellbore in combination with a casing cutter and spear.
Figure 2:
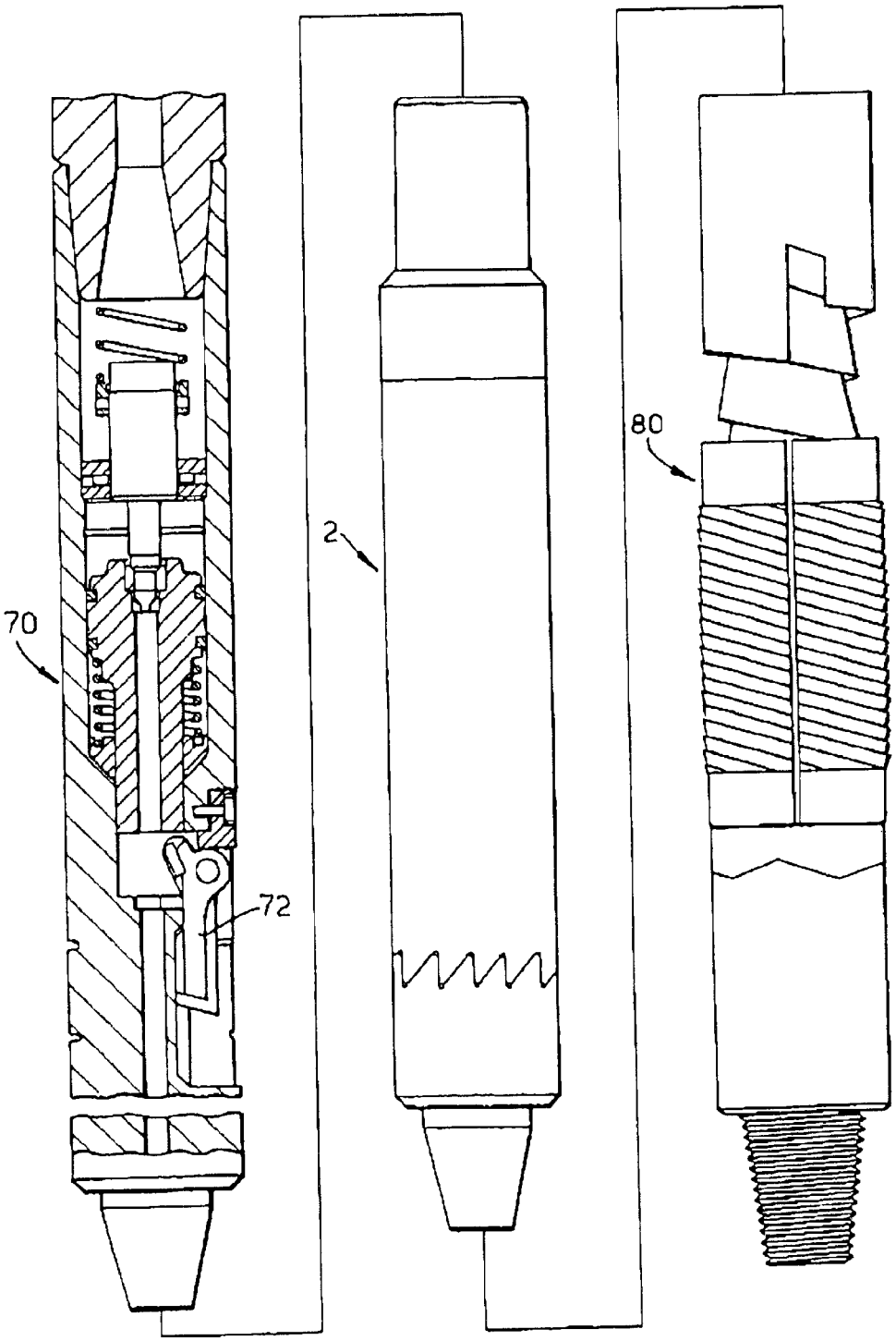
FIG. 2 is a detailed view of apparatus according to the invention in combination with a conventional rotary casing cutter and spear.

Referring to FIG. 1, apparatus according to the invention (a tension swivel sub 2) is shown located in a wellbore casing 60 with a conventional rotary casing cutter 70 and a conventional spear 80. The casing cutter 70 is positioned uphole of the swivel sub 2 and comprises cutter blades 72 which may be extended from a stored position so as to engage the adjacent region of wellbore casing and, through rotation of the cutting string, sever said region of the casing. This operation is well known to those skilled in the art The spear 80 is positioned downhole of the swivel sub 2 and engages the wellbore casing 60 so that an uphole force may be applied to a portion of casing located below the line of severing. The purpose of the swivel sub 2 is to provide means for setting and unsetting the spear and to allow an uphole force to be applied to the set spear whilst allowing rotary operation of the casing cutter. A more detailed view of the casing cutter 70, the swivel sub 2 and the spear 80 is provided in FIG. 2. The casing cutter 70 and spear 80 are both of a conventional design and their operation will be readily understood by the skilled person. Consequently, detailed discussion of these items of equipment will not be presented.

Figure 3:
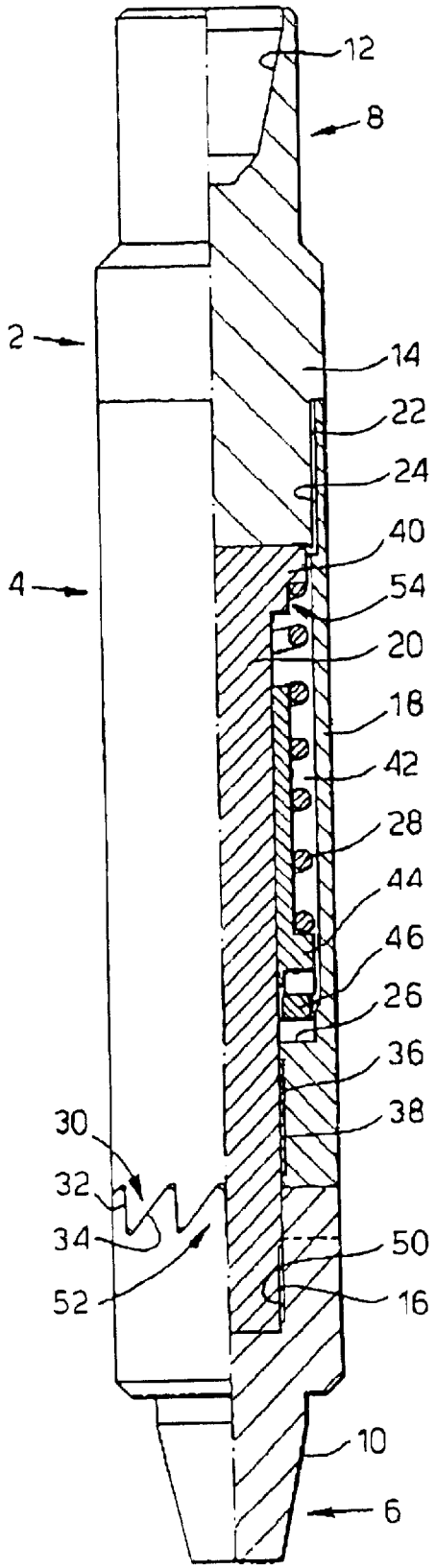
FIG. 3 is a cross-section view of apparatus according to the invention.

Referring to FIG. 3, the tension swivel sub 2 has a body 4 which is of a generally cylindrical shape with connecting means 6,8 provided at either end. The connecting means 6 provided at the downhole end of the body 4 is in the form of a male connector having external screw threads 10 for interengagement with an assembly downhole of the swivel sub 2. In contrast, the connecting means 8 located at the uphole end of the body 4 is in the form of a female connector having internal screw threads 12 for interengagement with an assembly uphole of the swivel sub 2.

The body 4 is made up of a drive sub 14, a driven sub 16, an annular drive sleeve 18, a driven mandrel 20 and a number of additional components assisting and controlling relative movement between the aforementioned driving and driven elements.

The drive sub 14 is generally cylindrical in shape and at the uphole end thereof is integrally provided with the female connecting means 8. The downhole end of the drive sub 14 is provided with external screw threads 22 for interengagement with corresponding internal screw threads 24 provided on the uphole end of the annular drive sleeve 18.

The annular drive sleeve 18 is cylindrical in shape and is provided with an internal shoulder 26 at the downhole end thereof. The shoulder 26 has the function of applying a compression force on a compression spring 28. The downhole end of the annular drive sleeve 18 is also provided with a multiplicity of teeth 30. The teeth 30 extend longitudinally from the downhole end of the sleeve 18 and each tooth is configured so as to have a leading face 32 lying in the same plane as that in which the central longitudinal axis of the swivel sub 2 lies. Each tooth of the multiplicity of teeth 30 is further configured to have a trailing face 34 positioned at approximately 45° to the leading face 32 and to have the shape of a right angled triangle with opposite and adjacent sides of the same length.

The inner surface of the drive sleeve 18 located between the internal shoulder 26 and the multiplicity of teeth 30 is provided with a recess 36 for receiving a radial bearing 38. The radial bearing 38 engages the external surface of the driven mandrel 20 so as to assist relative rotational movement between the mandrel 20 and the sleeve 18. The driven mandrel 20 is provided with an external shoulder 40 which is located at the upbole end thereof and is adapted to apply a compression force on the compression spring 28. The drive sleeve 18 and driven mandrel 20 are dimensioned so that the sleeve internal shoulder 26 extends radially to the external surface of the mandrel 20 and so that the mandrel external shoulder 40 extends radially to the internal surface of the sleeve 18. The arrangement is such that relative rotational and longitudinal movement between the sleeve 18 and the mandrel 20 may occur without excessive undesirable movement in a transverse direction which effectively generates a bend in the tension swivel sub 2.

Furthermore, the arrangement of the sleeve 18 and the mandrel 20 provides a spring chamber 42 for the housing of the compression spring 28, an extension arrester 44 and a thrust bearing assembly 46. The compression spring 28 locates within the spring chamber 42 so as to directly contact the shoulder 40 of the mandrel 20. The downhole end of the spring 28 abuts a downhole end of the extension arrester 44 which reacts spring force to the sleeve internal shoulder 26 by means of the thrust bearing assembly 46 located therebetween. The primary function of the thrust bearing assembly 46 is to assist the rotation of the driven components (i.e. the mandrel 20 and the driven sub 16) relative to the driving components (i.e. the sleeve 18 and the drive sub 14).

The downhole end of the mandrel 20 is provided with external screw threads 48 for interengagement with corresponding internal screw threads 50 provided on the driven sub 16. The driven sub 16 is generally cylindrical in shape and at the downhole end thereof is integrally provided with the male connecting means 6. The uphole end of the driven sub 16 is provided with a multiplicity of teeth 52 adapted for interengagement with the multiplicity of teeth 30 provided on the annular drive sleeve 18. Each tooth of the multiplicity of teeth 52 provided on the driven sub 16 has an identical shape, but reverse orientation, to each tooth of the sleeve 18. With the two sets of teeth 30,52 interengaged, the uphole end of the mandrel 20 locates adjacent the downhole end of the drive sub 14. It is preferable, however, that the mandrel 20 and drive sub 14 do not abut one another. In this way, the two sets of teeth 30,52 are firmly pressed together by means of the compression spring 28 and excessive relative rotational movement at the teeth 30,52 interface is minimised.

The extension arrester 44 is configured so as to allow sufficient axial movement of the driven components relative to the driving components to ensure complete disengagement of the two sets of teeth 30,52. However, excessive relative axial movement is prevented through abutment of an uphole end of the extension arrester 44 with the mandrel external shoulder 40. In this way, excess movement over that necessary to disengage the teeth 30,52 is prevented. Such excess movement could potentially render the tension swivel sub 2 vulnerable to undesirable bending. The mandrel external shoulder 40 shown in FIG. 3 has a stepped surface 54 which provides positive location for the uphole end of the compression spring 28.

In use, the casing cutter 70 is attached to the drive sub 14 by mean of the female connecting means 8. The casing spear 80 is attached to the driven sub 16 by means of the male connecting means 6. The resultant string is then run into a wellbore and located at the required depth. Although the spear 80 is suspended from the driven sub 16, the compression spring 28 has sufficient stiffness to maintain the two sets of teeth 30,52 in firm engagement with each other. The casing spear 80 is set by means of an appropriate rotation of the string. This rotation is transmitted to the spear via the engaged sets of teeth 30,52. Once the spear 80 has been set so as to grip the wellbore casing 60, an uphole force is applied to the string which is sufficient to move the driving and driven components from a retracted position (in which the two sets of teeth 30,52 are firmly engaged) to an extended position (in which the uphole end of the arrester 44 is in abutment with the mandrel external shoulder 40). Thus, the uphole force places the region of casing located below the spear 80 in a state of tension. Furthermore, movement of the driving and driven components into the extended position allows free rotation of the driving components and the string located thereabove. The casing cutter 70 is then rotated so as to sever the wellbore casing 60. Once the cutting operation has been completed, the uphole force on the string, and accordingly the tension in the casing below the spear 80, is slowly reduced to zero. The two sets of teeth 30,52 re-engage as a result and the driven sub 16 is rotated so as to release the spear 80. The casing cutter 70, the tension swivel sub 2, and the casing spear 80 may be then removed from the wellbore.

The present invention is not limited to the specific embodiment described above. Alternative arrangements will be apparent to a reader skilled in the art. The swivel sub 2 illustrated in FIG. 3 is not provided with a throughbore suitable for the circulation of wellbore fluid. However, such a throughbore may be conveniently defined as required. Similarly, passages and tubing for hydraulic actuating fluid may be extended through tile swivel sub 2 (for example, along the longitudinal axis of the swivel sub 2) as necessary. As a further variation, the swivel sub 2 may be provided with biasing means in the form of a gas compression chamber rather than a coil compression spring.

What is claimed is:

1. Apparatus for use in a wellbore comprising: a first elongate member provided with at least one tooth; a second elongate member provided with at least one tooth; the first and second elongate members being arranged in telescopic relation to one another so as to be moveable relative to one another in a longitudinal direction between a retracted position in which the at least one tooth of the first elongate member is engaged with the at least one tooth of the second elongate member so as to prevent relative rotation between said elongate members, and an extended position in which the at least one tooth of the first elongate member is completely disengaged from the at least one tooth of the second elongate member so as to permit relative rotation between said elongate members and in which abutment surfaces of said elongate members are in mechanical communication with each other so as to prevent further extending longitudinal movement of said elongate members and thereby permit the transmission of a tension force through the apparatus via means provided on each of the first and second elongate members for connecting said members, when in use, to additional apparatus.

2. Apparatus as claimed in claim 1, including biasing means to bias the first and second elongate members into the retracted position.

3. Apparatus as claimed in claim 2, wherein the biasing means is a spring located between the abutment surfaces of said elongate members.

4. Apparatus as claimed in claim 3, wherein the spring has sufficient stiffness to maintain the elongate members in the retracted position when, during use, the apparatus is placed in a state of tension due to the suspension of downhole equipment from said apparatus.

5. Apparatus as claimed in claim 3 or 4, wherein a bearing is located between the abutment surfaces of said elongate members.

6. Apparatus as claimed in claim 1, wherein means for cutting a wellbore casing is connected to the first elongate member.

7. Apparatus as claimed in claim 1, wherein means for gripping a wellbore casing is connected to the second elongate member.

* * * * *